US005918882A

United States Patent [19]

Truong

[11] Patent Number: 5,918,882

[45] Date of Patent: Jul. 6, 1999

[54] GAME FOR TESTING ACUITY OF THE SENSES

[76] Inventor: Nhan D. Truong, 6327 Belle Grove Dr., Baton Rouge, La. 70820

[21] Appl. No.: 09/026,215

[22] Filed: Feb. 19, 1998

[51] Int. Cl.[6] ..... A63F 3/00

[52] U.S. Cl. ..... 273/249; 273/431

[58] Field of Search ..... 273/242, 243, 273/248, 249, 292, 429, 430, 431, 432

[56] References Cited

U.S. PATENT DOCUMENTS

| | | | |
|---|---|---|---|
| 1,877,643 | 9/1932 | Brown . | |
| 3,888,025 | 6/1975 | Schmieder | 35/35 |
| 4,315,628 | 2/1982 | Balash et al. | 273/296 |
| 4,368,459 | 1/1983 | Sapora | 340/407 |
| 4,487,585 | 12/1984 | Goldwasser | 434/259 |
| 4,508,510 | 4/1985 | Clifford | 434/247 |
| 4,840,374 | 6/1989 | Skinner | 273/1 |
| 5,259,623 | 11/1993 | Kanelos, Sr. | 273/249 |
| 5,277,429 | 1/1994 | Smith, III | 273/249 X |
| 5,310,195 | 5/1994 | Abdallah | 273/236 X |
| 5,316,308 | 5/1994 | Stembokas | 273/249 |

*Primary Examiner*—William E. Stoll
*Attorney, Agent, or Firm*—Shawn D. Sentilles

[57] ABSTRACT

A game for testing the senses comprising a game board having a start area, a finish area, and a playing area positioned between the start and finish. The playing area is divided into a plurality of sequential spaces. Indicia are provided on some of the spaces for providing instructions relating to selection of questions and for manuevering game piece icons through the playing area. Six sets of questions for testing the acuity of the senses are provided. One set of questions is provided for each of the six senses of sight, hearing, taste, smell, touch, and extrasensory perception. Each of the questions has a point value corresponding to the level of difficulty of the question. A random generator is provided for randomly selecting one of the questions on a turn-by-turn basis to thereby utilize the questions to play the game. The random generator for random selection is preferably weighted such that the random generator is most likely to select a question for touch, less likely to select a question for sight than for taste, hearing, or smell, and least likely to select a question for extrasensory perception.

24 Claims, 1 Drawing Sheet

GAME FOR TESTING ACUITY OF THE SENSES

FIELD OF THE INVENTION

The present invention relates to games utilizing the senses, and more particularly to a game which utilizes the five ordinary senses and a sixth sense, extrasensory perception, to maneuver an icon around a game board.

BACKGROUND OF THE INVENTION

All games generally require the use of at least one of the five ordinary senses. Sight is used in most games. Hearing is used in some musical games. Touch has also been used on occasion. See e.g. U.S. Pat. No. 1,877,643 (Brown) and U.S. Pat. No. 4,840,374 (Skinner). One game has combined the use of smell and sight. U.S. Pat. No. 4,487,585 (Goldwasser). Another game has attempted to combine the use of hearing and sight to teach a foreign language. U.S. Pat. No. 3,888,025 (Schmieder).

As far as is known, a game has not been designed which utilizes what is sometimes referred to as the "sixth sense," or extrasensory perception/ESP. Additionally, no game is known which is based on the use of a combination of three or more senses for testing sensual acuity and for maneuvering an icon around a game board.

There is a need for a game based on sensory acuity which is enjoyable for people of all ages, which can be played without the use of expensive or specialized accessories, and which is adaptable both for educational and leisure purposes.

OBJECTS AND SUMMARY OF THE INVENTION

It is an object of the invention to provide a game for testing acuity of the senses.

It is another object of the invention to provide a game which utilizes the five ordinary senses, as well as a six sense, extrasensory perception, for determining a winner.

It is another object of the invention to provide a game for testing acuity of the senses which can be played with ordinary household items.

It is yet another object of the invention to provide a board game which tests acuity of the senses.

These and other objects and advantages of the invention shall become apparent from the following general and preferred description of the invention.

Accordingly, a game for testing the senses is provided comprising a game board having a start area, a finish area, and a playing area positioned between the start and finish. The playing area is divided into a plurality of sequential spaces. Indicia are provided on some of said spaces for providing instructions relating to selection of questions and for maneuvering game piece icons through the playing area. Six sets of questions for testing the acuity of the senses are provided. One set of questions is provided for each of the six senses of sight, hearing, taste, smell, touch, and extrasensory perception. Each of the questions has a point value corresponding to the level of difficulty of the question. A means is provided for randomly selecting one of the questions on a turn-by-turn basis to thereby utilize the questions to play the game. The means for random selection is preferably weighted such that the means is most likely to select a question for touch and less likely to select a question for sight than for taste, hearing, or smell.

Methods of playing the game are also provided. These methods include having players take turns in an assigned sequence of play to thereby maneuver each player's assigned icon through the playing area. Each step of taking a turn comprises operating the means to thereby randomly select one of the sets of questions, selecting a question from the selected set of questions, and attempting to answer the selected question. The sequence of taking a turn is repeated until one of the players wins the game by maneuvering that player's assigned icon to the finish before any other player.

PREFERRED EMBODIMENTS OF THE INVENTION

Figure 1:
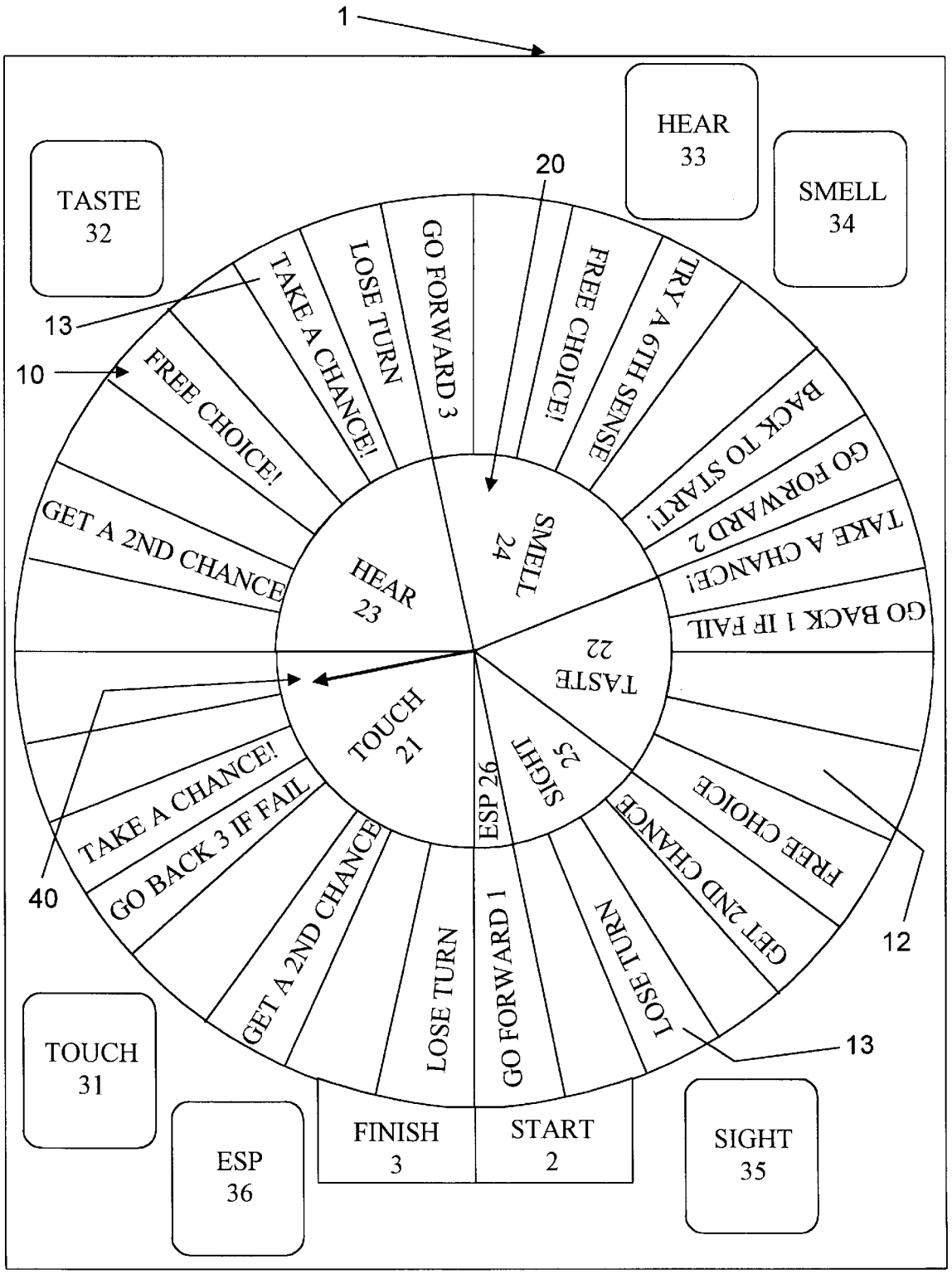
FIG. 1 shows one embodiment of a game board for use in playing the game according to the invention.

Although the game can be adapted for use in many settings, such as for use with a game board, with a computer, or for use as a card game, the premise of the game is to use commonly available sights, sounds, smells, tastes, and textures to test the sensual acuity of players, and to thereby determine a winner of the game. An added feature of the game is that it tests the acuity of a player's sixth sense, extrasensory perception. While recognizing that there is as yet no scientific basis for extrasensory perception, and that testing of extrasensory perception generally amounts to mere guessing, for convenience in describing the game, extrasensory perception will be referred to herein as the "sixth sense." Accordingly, the following is a description of a preferred embodiment of a game which utilizes and tests the six senses.

An apparatus for the game consists of a game board 1, a means 40 such as a spinner 40 for randomly selecting one of the six senses, six decks of cards 31–36 corresponding to each of the six senses (i.e. a deck for touch 31, taste 32, hearing 33, smell 34, sight 35, and extrasensory perception 36), two or more game piece icons, a timer, ear plugs or other means for temporarily preventing a player from hearing, and a blindfold, sleep patch, or other means for temporarily preventing a player from seeing. The icons are standard game pieces, such as are typically used in board games, and are distinctive, such as by color or shape, so that a player can distinguish his or her icon from those of other players. The game can also be provided with a random number generator, such as a die, for determining the sequence of play.

As shown in FIG. 1, in the preferred embodiment, the game board 1 is a standard game board, such as a square or rectangular cardboard game board which can be folded for storage. The game board 1 has a start area 2, a finish area 3, and a playing area 10 positioned between the start 2 and finish 3. Although the playing area 10 can be configured in any start to finish configuration, such as a spiral, or a line with multiple curves, in the preferred embodiment shown in FIG. 1, the playing area 10 is ring shaped.

The playing area 10 is divided into a plurality of sequential spaces 12. The playing area is preferably divided into about thirty-two spaces 12, although any number can be used depending on the desired length of the game. The icons are sized to substantially fit in the spaces 12, and preferably such that two or more icons can fit in a space 12 simultaneously. As shown in FIG. 1, indicia 13 can be provided on some or all of the spaces 12 on the playing area 10. The indicia 13 provide instructions relating to selection of questions and movement of icons through the playing area. Examples of some indicia 13, along with the meaning of each indicia 13, include:

"GET A SECOND CHANCE"—If a player failed to answer the question correctly, the player is allowed to select a new question and attempt to answer that question correctly.

"FREE CHOICE"—The player chooses the sense he or she would like to attempt to answer. In one variation, the player would not be allowed to chose a question for extrasensory perception.

"MUST LAND ON TOUCH TO ADVANCE"—The player must spin the needle and have the needle come to rest on the space marked "Touch" in order to continue his or her turn.

"TAKE A CHANCE"—After spinning the needle and selecting a question, the player is informed of the number of points on the card. The player then has the option, before the question is read, to double the number of points on the card. If the player guesses correctly, the player moves forward double the number of points on the card. If the player guesses incorrectly, the player moves backwards double the number of points on the card.

In the preferred embodiment shown in FIG. 1, a sensory selection area 20 is positioned inside of and concentric with the playing area 10. The sensory selection area 20 is divided into six sensory selection areas 21, 22, 23, 24, 25, and 26. One of the six senses is assigned to each of the six sensory selection areas 21–26. As shown in FIG. 1, in a preferred embodiment, a rotatable spinner 40 is positioned at the center of the sensory selection area 20 to thereby provide a means 40 for randomly selecting one of the six senses. The sensory selection areas 21–26 for the different senses are preferably configured such that some areas are larger than others, and therefore have a greater chance of being randomly selected by the spinner 40.

The means 40 can be any device capable of randomly selecting from a chosen number of discrete units, such as a die having indicia corresponding to the senses, or a computer subroutine programmed to randomly select one of the senses. The means 40 can consist of the cards themselves. For example, the different sets of cards can be shuffled together and a card can be drawn at random from the combined stack of cards.

The means for randomly selecting 40 a question is preferably weighted such that the means is most likely to select a question for touch, less likely to select a question for sight than for taste, hearing, or smell, and least likely to select a question for extrasensory perception. In order to balance the chance of a particular sense being selected with a desired rate at which the game is to be played, the weighting can be based on the total number of available points for each particular sense. This can be accomplished by making the chance of selecting a particular sense inversely proportional to the total number of points available for that particular sense, i.e. the more points that are available for a particular sense, the less likely it will be that a player will randomly select that particular sense. Since ESP questions are particularly difficult, they will generally be worth more points. If players are equally likely to select ESP as any of the other senses, the game might be completed too quickly without providing an opportunity to select a sufficient number of questions from the other senses. As an example, if the total available points are distributed as follows: taste 16 percent, smell 14 percent, hearing 14 percent, touch 12 percent, sight 16 percent, and extrasensory perception 28 percent, then the chances of randomly selecting each of the senses might be as follows: taste 17.3 percent, smell 18.6 percent, hearing 18.6 percent, touch 20 percent, sight 16.2 percent, and extrasensory perception 9.3 percent.

In the preferred embodiment, a total of six hundred and sixty cards are provided. The cards are divided into six sets, with one set corresponding to each of the six senses. Sixty cards are provided for extrasensory perception, and one hundred and twenty cards are provided for each of the remaining senses of sight, hearing, taste, smell, and touch. The total number of cards and the total number of cards per set can be varied.

Each card is provided with a question. Each of the questions in each of the sets is designed to test a player's sensory acuity for that particular sense The questions are not intended to be read to the player attempting to answer the question, but instead provide instructions to another player, who carries out the instructions on the question, as will be described further below. Each of the questions preferably has a point value which corresponds to the level of difficulty of the question. The following are examples of questions for each of the six senses:

"Taste three drops of a soft drink. Use a dropper or straw to place the drops on the player's tongue. The response must be specific (i.e. "Coke®," "Sprite®"). 3 points."

"Smell a clean towel. 2 points."

"Listen to a book being dropped on the floor. 3 points."

"Touch the end of a Q-tip with two fingers. 1 point."

"Read a title of a book from ten feet away. 2 points."

"Guess what letter the player sitting across from you just wrote down on a piece of paper. 10 points."

Tables 1–6 provide detailed examples of questions for each of the six senses.

TABLE 1

| | "TASTE" QUESTIONS | | |
|---|---|---|---|
| | ONE POINT | THREE POINTS | FIVE POINTS |
| 1 | Taste a few grains of salt | Lick a clean roll of paper towel | Lick a clean sheet of paper |
| 2 | Taste a few grains of sugar | Lick a clean page of a magazine | Lick an egg (its shell) |
| 3 | Taste two drops of lime or lemonade | Lick a clean page of a book | Lick a bowl or a plate |
| 4 | Drink a spoon of soft drink. Must be specific (i.e. Coke vs. Sprite) | Taste 3 drops of soft drink. Be specific | Taste 1 drop of soft drink |
| 5 | Drink a spoon of beer or wine | Taste 3 drops of beer or wine | Taste 1 drop of milk |
| 6 | Drink a spoon of milk. Be specific (i.e. skim vs. Whole milk) | Taste 3 drops of milk. Be specific | Taste 1 drop of beer or wine |
| 7 | Drink a spoon of juice drink. Be specific (i.e. Orange vs. Apple) | Taste 3 drops of juice drink. Be specific | Taste 1 drop of a sports drink |
| 8 | Drink a spoon of sports drink | Taste 3 drops of sports drink | Taste 1 drop of juice drink |
| 9 | Drink a spoon of coffee | Taste 3 drops of coffee | Taste 1 drop of coffee |
| 10 | Drink a spoon of water | Taste 3 drops of water | Taste 1 drop of water |
| 11 | Eat 1 potato chip | Lick 1 potato chip | Lick a pen's body |
| 12 | Eat a piece of cheese | Lick a piece of cheese | Lick a pencil body |
| 13 | Eat a piece of cold cut (i.e. turkey, salami, . . . ) | Lick a piece of cold cut (i.e. turkey, salami, . . . ) | Lick an erasure |
| 14 | Eat a piece of hot dog | Lick a piece of hot dog | Lick a capped toothpaste bottle |
| 15 | Eat a portion of a fruit. Must be specific (i.e. banana vs. Apple) | Lick a portion of a fruit. Must be specific (i.e. banana vs. Apple) | Lick someone's skin (a part of the arm or hand that does not have hair) |
| 16 | Eat a piece of vegetable. Be specific | Lick a piece of vegetable. Be specific | Lick a book's cover |
| 17 | Eat a piece of pickle | Lick a piece of pickle | Lick aluminum foil |
| 18 | Eat a piece of bread or bagel | Lick a piece of bread or bagel | Lick a ziplock bag |
| 19 | Eat some (¼ of a teaspoon) ketchup | Lick a clean towel | Lick a paper bag |
| 20 | Eat some buffer | Lick a clean T-shirt | Lick a clean "glass" glass |
| 21 | Eat some cream cheese | Lick a clean sweater | Lick a clean plastic cup |
| 22 | Eat some peanut butter | Lick a clean dress pant | Lick a clean coffee mug |
| 23 | Eat a candy | Lick a candy | Lick a utensil (spoon or fork) |
| 24 | Eat a piece of a chocolate candybar | Lick a chocolate candy bar | Lick the outside of a shampoo's bottle |
| 25 | Eat a piece of a cookie | Lick a cookie | Lick a belt |
| 26 | Eat a spoon of cereal | Lick a cereal | Lick a hat |
| 27 | Eat a piece of a pretzel | Lick a pretzel | Lick a clean pair of jeans |
| 28 | Eat some mayonnaise | Lick a dress shirt | Lick a leather item (i.e. a jacket) |
| 29 | Eat some mustard | Lick a snack (biscuit or cracker) | Lick a tie |
| 30 | Eat some jelly | Lick a left-over food in the refrigerator | Lick a clean CD case |
| 31 | Eat some pudding | Lick a body of a candle | |
| 32 | Taste a spoon of salad dressing | Lick a skin of a fruit | |
| 33 | A spoon of Jell-O | Lick a left-over food item in the refrigerator | |
| 34 | Eat some snack (biscuit or cracker) | Lick some spice | |
| 35 | Eat some left-over food in refrigerator | Taste 1 drop of Scope or its equivalent | |

TABLE 2

"SMELL" QUESTIONS

| | ONE POINT | THREE POINTS | FIVE POINTS |
|---|---|---|---|
| 1 | Bleacher | Clean towel | Vaseline |
| 2 | Laundry detergent | Clean cloth | Player sitting opposite |
| 3 | Fabric softener | Liquid Drano or its equivalent | Player sitting to the right |
| 4 | General purpose cleaner (i.e. 409) | Lips' lotion (i.e. chapstick) | Player sitting to the left |
| 5 | Soap scum remover (i.e. Tilex) | Mousse | Cooking oil |
| 6 | Soap | Liquid medicine | A clean sheet of paper |
| 7 | Air freshener | Band-aid (opened) | A newspaper |
| 8 | Pledge or its equivalent | Clean toilet paper | A magazine (opened) |
| 9 | Dish washing liquid | Dirty cloth | A film negative |
| 10 | Carpet cleaner | Vegetable. Be specific | A coin |
| 11 | Window cleaner | Soft drink | Make up |
| 12 | Lotion | Juice drink | Leathered belt or cloth |
| 13 | Lipstick | Candy | A used glove or mitten |
| 14 | Perfume or cologne | Cookie | A used hat |
| 15 | Nail polisher | Sugar | A used coat or jacket |
| 16 | Deodorant | Salt | Soil or dirt |
| 17 | Shaving cream | Green onion | A tablet of an over-the-counter medicine |
| 18 | Shampoo or conditioner | Garlic | A brief case |
| 19 | Tooth paste | Potato | A key chain |
| 20 | Scope or its equivalent | Cream cheese | A duffy bag or school bag |
| 21 | Hair spray | Cheese | |
| 22 | Dirty sock | Bread or bagel | |
| 23 | Shoe | Pen | |
| 24 | Lime or lemonade | Pencil | |
| 25 | A fruit: Be specific (i.e. banana vs. Apple) | Glue | |
| 26 | Milk | Scotch tape | |
| 27 | Chocolate candy bar | A dollar bill | |

TABLE 2-continued

"SMELL" QUESTIONS

| | ONE POINT | THREE POINTS | FIVE POINTS |
|---|---|---|---|
| 28 | Cereal (opened box) | A wallet or a purse | |
| 29 | Mayonnaise | Make up | |
| 30 | Mustard | Spices | |
| 31 | Pepper | Pillow | |
| 32 | White onion | Blanket | |
| 33 | Tomato | Motor oil | |
| 34 | Coffee | Grass | |
| 35 | Coffee cream | Flower | |
| 36 | Ketchup | Leaves | |
| 37 | Butter | Mulch | |
| 38 | Peanut butter | Left-over food in the refrigerator. Be specific | |
| 39 | Salad dressing | Potato chip | |
| 40 | Chocolate or cocoa | Snack food (i.e. cracker) | |

TABLE 3

"HEARING" QUESTIONS

| | ONE POINT | THREE POINTS | FIVE POINTS |
|---|---|---|---|
| 1 | Gargling | Pour water from one glass to another | Eating |
| 2 | Chewing crunchy foods | Drinking | Sipping |
| 3 | Turning on and off the radio | Cracking an egg | Walking back and forth |
| 4 | Turning on & off the hair dryer | Dropping a thick book onto a hard surface (a floor or a table) | Laying a bowl on a table with one hand |
| 5 | Clap hands twice | Spin a quarter on the table and let it stop by itself | Laying a spoon on a table with one hand |
| 6 | Zipping a zipper twice | A blow | Laying a thick book on a table with one hand |
| 7 | Writing (10 words) | A sigh | Dropping a plastic cup onto a hard surface |
| 8 | Tapping a pen/pencil on table (10 taps) | A yawn | Dropping a utensil onto a hard surface |
| 9 | Tapping a pencil's erasure on table (10 taps) | Clap hands once | Dropping a pen/pencil onto a hard surface |
| 10 | Erasing on paper with an erasure | Zipping a zipper once | Dropping a coin onto a hard surface |
| 11 | Tapping with shoe on hard surface (10 taps) | Comb hair with a brush | Dropping a shoe onto a hard surface |
| 12 | Tapping without shoe on hard surface (10 taps) | Writing (3 words) | Flipping a switch to turn off the room's light |

TABLE 3-continued

| | "HEARING" QUESTIONS | | |
|---|---|---|---|
| | ONE POINT | THREE POINTS | FIVE POINTS |
| 13 | Tapping with hand op hard surface (10 taps) | Tapping a pen/pencil on table (3 taps) | Stretching both arms |
| 14 | Tapping with fingers on table (10 times) | Tapping a pencil's erasure on table (3 taps) | Tapping a pen/pencil on table (1 tap) |
| 15 | Knocking on table (10 times) | Tapping with shoe on hard surface (3 taps) | Tapping a pencil's erasure on table (1 tap) |
| 16 | Biting an apple or a pickle | Tapping with hand on hard surface (3 taps) | Tapping with shoe on hard surface (1 tap) |
| 17 | Sucking a candy | Tapping with fingers on table (3 time) | Tapping with hand on hard surface (1 tap) |
| 18 | Scratching head | Knocking on table (3 times) | Tapping with fingers on table (1 time) |
| 19 | Cracking knuckles | Scratching leg with pants | Knocking on table (1 time) |
| 20 | Tearing a piece of paper 3 times | Rubbing face with both hands | Standing up and sitting down |
| 21 | Stabling 5 times | Rubbing foot's heel | |
| 22 | Rolling a coin across table 3 times; let it stop | Rubbing shin (that has hair) | |
| 23 | Rolling a pen/pencil across table 3 times | Wiping table with dry hand | |
| 24 | Clearing throat 3 times | Tearing a piece of paper once | |
| 25 | Player sitting opposite says "Can you guess who I am?" | Crumble a piece of paper in both hands | |
| 26 | Player sitting to the right says "Can you guess who I am?" | Sliding a thick book across the table 3 times | |
| 27 | Player sitting to the left says "Can you guess who I am?" | Stabling 2 times | |
| 28 | Player sitting opposite laughs | Rolling a coin across table once; let it stop | |
| 29 | Player sitting to the right laughs | Rolling a pen/pencil across table 1 time | |
| 30 | Player sitting to the left laugh | Clearing throat once | |
| 31 | Clock ticking | Player sitting opposite says "Can you guess who I am?" | |
| 32 | Dripping water into a glass (drop by drop) | Player sitting opposite says "Guess who ?" | |
| 33 | Patting someone on the back 5 times | Player sitting to the right says "Guess who ?" | |
| 34 | Rubbing both hands together | Player sitting to the left says "Guess who?" | |
| 35 | Thumbing on table 5 times | Patting someone on the back 3 times | |
| 36 | Water running from a faucet in a nearby room | Clapping with feet (with shoes) 5 times | |
| 37 | Opening & closing a door of the same room | Clapping with feed (without shoes) 5 times | |
| 38 | Opening & closing a drawer in the same room | Thumbing on table 3 times | |
| 39 | Opening & closing a cabinet door in the same room | Water running from a faucet in a distant room | |
| 40 | Flipping light switch ON/OFF (same room) | Opening & closing a thick book | |

TABLE 4

"TOUCH" QUESTIONS

| | ONE POINT (2 FINGERS) | THREE POINTS (2 FINGERS) | FIVE POINTS (1 FINGER) |
|---|---|---|---|
| 1 | A pencil | A surface of a piece of paper | A body of a pencil |
| 2 | A pen | Two nearby edges of an envelope | A body of a pen |
| 3 | A piece of paper | A surface of a book's cover | A page inside an album |
| 4 | A stamp | A surface of a magazine's cover | Outside surface of a plastic cup |
| 5 | An envelope | A surface of a newspaper | Outside surface of a glass |
| 6 | A picture | A surface of a note book | A surface of a plate |
| 7 | A scotch tape | A surface of a manila folder | An inside surface of a bowl |
| 8 | A book | A surface of a CD | A surface of an utensil's handle |
| 9 | A magazine | A surface of an album's cover | A surface of a straw |
| 10 | A newspaper | A bottom edge of a plastic cup | A surface of a cheese's slice |
| 11 | A note book | A bottom edge of a glass | A surface of an egg's carton |
| 12 | A manila folder | A bottom edge of a plate | A surface of a soft drink can or bottle |
| 13 | A stapler | A bottom edge of a bowl | A surface of a dish washing liquid bottle |
| 14 | A computer floppy disk | A body of a straw | An inside surface of a pot/pan |
| 15 | A CD | A surface of paper towel or napkin | A surface of a bleacher/cleaner bottle |
| 16 | A cassette tape | A few grain of salt | A surface of a spray can |
| 17 | A video tape | A bottom edge of a soft drink can or bottle | A surface of a shampoo/conditioner bottle |
| 18 | A ruler | A drop of dish washing liquid | A surface of a shaving cream bottle |
| 19 | A measuring tape | A holder of a pot/pan's lid | A surface of a deodorant bottle |
| 20 | A photo album | A bottom edge of a bleacher/cleaner bottle | A surface of a tooth paste bottle |
| 21 | A picture frame | A bottom edge of a spray can | |
| 22 | A plastic cup | A few "grains" of laundry detergent | |
| 23 | A glass | A little shampoo or conditioner | |
| 24 | A plate | A little shaving cream | |
| 25 | A bowl | A little deodorant | |
| 26 | A utensil | | |
| 27 | A straw | | |
| 28 | A paper towel or napkin | | |
| 29 | A fruit. Must be specific | | |
| 36 | A vegetable. Must be specific | | |
| 31 | An onion | | |
| 32 | A slice of cheese | | |
| 33 | An egg | | |
| 34 | An egg carton | | |
| 35 | A salt bottle | | |
| 36 | A soft drink can or bottle | | |
| 37 | A dishwashing liquid bottle | | |
| 38 | A pot or a pan | | |
| 39 | A lid of a pot or a pan | | |
| 40 | A bottle of bleacher or general cleaner | | |
| 41 | A spray can with a cap on top (i.e. pledge, hair spray) | | |
| 42 | A sheet of fabric softener (i.e. Bounce) | | |
| 43 | A box of laundry detergent | | |
| 44 | A dust pan | | |

TABLE 4-continued

| | "TOUCH" QUESTIONS | | |
|---|---|---|---|
| | ONE POINT (2 FINGERS) | THREE POINTS (2 FINGERS) | FIVE POINTS (1 FINGER) |
| 45 | A bottle of shampoo or conditioner | | |
| 46 | A box of soap | | |
| 47 | A Q-tip | | |
| 48 | A opened bottle of shaving cream | | |
| 49 | Deodorant bottle | | |
| 50 | Tooth paste bottle | | |
| 51 | Toilet paper | | |
| 52 | Toilet paper holder | | |
| 53 | Clean towel | | |
| 54 | A hair dryer | | |
| 55 | A bottle of perfume or cologne | | |

TABLE 5

| | "SIGHT" QUESTIONS | | |
|---|---|---|---|
| | ONE POINT | THREE POINTS | FIVE POINTS |
| 1 | Identify an added apostrophe (by a pen) in a book's page filled with words | Identify 3 differences between two $1 bills (use a pen to make 3 mark on both sides of one bill) | Identify 5 differences between two $1 bills (use a pencil to make 5 marks on both sides of one bill) |
| 2 | Identify one difference between two $1 bills (one of the numbers on one of two $1 bill is changed by a pen) | Count the number of letters in the definition of sensation | Count the number of vowels in the definition of dictionary |
| 3 | Count the number of bold words in one page of a dictionary | Count the number of items in your refrigerator | Count the number of items in your pantry |
| 4 | Count the number of items in your refrigerator's door | How many colors are there on a cover of a magazine? | How many colors are there in your refrigerator? |
| 5 | How many paint colors are there in your house? | Find 2 objects that don't belong in a refrigerator (just place a coin on top of a milk bottle and toothpaste cap next to an egg) | Find 5 objects that don't belong in a pantry (don't hide place objects in viewing areas: a dollar bill, a slice of cheese, a credit card, a driver license, and picture. |
| 6 | Find 1 object that doesn't belong in a medicine cabinet (don't hide; just place a pen or pencil in a viewing area) | Find a dime in the kitchen (on top of a toaster) | Find a penny in a family room |
| 7 | Find a book with a dollar bill being used as its page finder (?) on a book shelf | Sit 10' away from table (eye level must not be above table top). Arrange a coffee mug to be directly 1' in front of a tall plastic cup. Estimate the distance between 2 objects. | Sit 10' away from table (eye level must not be above table top). Arrange a coffee mug to. be directly 1' in front of a tall plastic cup. Estimate the distance between 2 objects with just one eye. |
| 8 | Sit 5' away from table (eye level must not be above table top). Arrange a coffee mug to be directly 1' in front of a tall plastic cup. Estimate the distance between 2 objects. | Lie down on the floor; 10" away from a coke can which is exactly 6" directly in front of a coke bottle. Estimate the distance | Lie down on the floor; 10' away from a coke can which is exactly 6" directly in front of a coke bottle. Estimate the distance with just one eye |
| 9 | Lie down on the floor; 5' away from a coke can which is exactly 6" directly in front of a coke bottle. Estimate the distance | Draw 2 long (10") parallel lines coming toward the guessing player. The width between the lines in the front is 4" while that in the back is 1". Draw 2 | Draw 2 long (10") parallel lines coming toward the guessing player. The width between the lines in the front is 4" while that in |

TABLE 5-continued

| | "SIGHT" QUESTIONS | |
|---|---|---|
| ONE POINT | THREE POINTS | FIVE POINTS |
| | horizontal bars: ½" at the front & ⅝" at the back. Estimate which one is longer? | the back is 1". Draw 2 identical horizontal bars (0.5") and place them one near the front and the other near the back. Estimate which one is longer? |
| 10 Draw 2 long (10") parallel lines coming toward the guessing player. The width between the lines in the front is 4" while that in the back is 1". Draw 2 horizontal bars: ½" at the front & ⅜" at the back. Estimate which one is longer? | Draw 2 long (10") parallel lines coming toward the guessing player. The width between the lines in the front is 4" while that in the back is 1". Draw 2 vertical bars: ½" at the front & ⅝" at the back. Estimate which one is longer? | Draw 2 parallel lines as above but the 2 bars are vertical. Estimate which one is shorter? |
| 11 Draw 2 long (10") parallel lines coming toward the guessing player. The width between the lines in the front is 4" while that in the back is 1" . Draw 2 vertical bars: ½" at the front & ⅜" at the back. Estimate which one is longer? | Draw an arch with width of 2¼" & height of 2¼ Estimate which one is longer. | Draw an arch with width of 2¼" & height of 2⅛". 2⅛". Estimate which one is longer. |
| 12 Draw an arch with width of 2⅛" & height of 2¼". Estimate which one is longer. | Pull a strand of hair out of someone's hand with one eye opened | Touch a strand of hair with a 5' long stick with one eye opened |
| 13 Pull a strand of hair out of someone's hand with both eyes opened | Hit a book (the size of a dictionary) with a tennis ball 5' away with one eye opened | Hit a book (the size of a dictionary) with a tennis ball 10' away with one eye opened |
| 14 Hit a book (the size of a dictionary) with a tennis ball 5' away with both eyes opened | Estimate the distance of a Coke can 10' away | Estimate the distance of a coke can 10' away with one eye opened |
| 15 Estimate the distance of a coke can 5' away | One player stands up and walk 15 steps. Estimate how many steps? | One player stands up and walk 21 steps. Estimate how many steps' |
| 16 One player stands up and walk 5 steps. Estimate how may steps? | Pour 1 oz into a "glass" glass. Estimate how much. | Pour 1 pint (2 cups or 8 oz) into a "glass" glass. Estimate how much. |
| 17 Pour 1 tablespoon into a "glass" glass. Estimate how much. | Estimate within 5 lb. the weight of the player sitting opposite | Estimate within 2 lb. the weight of the player sitting opposite |
| 18 Estimate within 10 lb the weight of the player sitting opposite | Estimate within 5 lb. the weight of the player sitting to the right | Estimate within 2 lb. the weight of the player sitting to the right |
| 19 Estimate within 10 lb the weight of the player sitting to the right | Estimate within 5 lb. the weight of the player sitting to the left | Estimate within 2 lb. the weight of the player sitting to the left |
| 20 Estimate within 10 lbs. the weight of the player sitting to the left | Estimate within 5" the height of the player sitting opposite | Estimate within 2" the height of the player sitting opposite |
| 21 Estimate within 10" the height of the player sitting opposite | Estimate within 5" the height of the player sitting to the right | Estimate within 2" the height of the player sitting to the right |
| 22 Estimate within 10" the height of the player sitting to the right | Estimate within 5" the height of the player sitting to the left | Estimate within 2" the height of the player sitting to the left |
| 23 Estimate within 10" the height of the player sitting to the left | Read a title of book or a magazine (words about ¼" high) 10' away | Read a title of book or a magazine (words about ¼" high) 15' away |
| 24 Read a title of book or a magazine (words about ¼" high) 5' away | Read a line from a magazine or a book 4' away | Read a line from a magazine or a book 6' away |
| 25 Read a line from a magazine or a book 2' away | Identify 14 things in the kitchen in 20 secs | Identify 23 things in the pantry in 10 secs |

TABLE 5-continued

"SIGHT" QUESTIONS

| | ONE POINT | THREE POINTS | FIVE POINTS |
|---|---|---|---|
| 26 | Identify 10 things in the room playing in 30 sec | Set up 12 different objects on table. Allow 10 secs; then identify with eyes blindfolded. | Set up 16 different objects on table. Allow 5 sec; then identify with eyes blindfolded |
| 27 | Set up 10 different objects on table. Allow 20 secs; then identify with eyes blindfolded | Stare at very close distant a large green object for 3 min., then guess what is a color of a white sheet of paper | Stare at very close distant a large green object for 5 min., then guess what is a color of a white sheet of paper |
| 28 | Stare at very close distant a large green object for 1 min., then guess what is a color of a red object | Stare at very close distant a large yellow object for 3 min., then guess what is a color of a white sheet of paper | Stare at very close distant a large yellow object for 5 min., then guess what is a color of a white sheet of paper |
| 29 | Stare at very close distant a large yellow object for 1 min., then guess what is a color of a blue object | How many items in the viewing area of your pantry are white? | Which color is the second most popular (the items in your pantry)? |
| 30 | How many items in the viewing area of your pantry are black? | How may different types of shapes are there in the viewing area of the room you're in? | How may different types of shapes are there in the viewing area of your refrigerator? |
| 31 | How many different types of shapes are there in your cabinet that stores bowls, plates, china, . . .? | How many items in the viewing area of your kitchen is rectangle? | Which shape has the second most number of items in the viewing area of your pantry? |
| 32 | How may items in the viewing area of your family room is oval? | Estimate within 3" the height of your refrigerator? | Estimate within 1" the height of your TV. |
| 33 | Estimate within 5" the height of a book. | Estimate how long is 1 minutes (no counting) | Estimate how long is 3 minutes (no counting) |
| 34 | Estimate how long is 10 sec (no counting) | | |

TABLE 6

"SIXTH SENSE" QUESTIONS
10 POINTS EACH

1 Guess what word the player sitting opposite just wrote down
2 Guess what word the player sitting to the right just wrote down
3 Guess what word the player sitting to the left just wrote down
4 Guess what letter the player sitting opposite just wrote down
5 Guess what letter the player sitting to the right just wrote down
6 Guess what letter the player sitting to the left just wrote down
7 Player sitting opposite says "I want to go and see . . ."then writes down what movie. Guess what movie she wants to see
8 Player sitting to the right says "I need to buy . . ." then writes down what he needs to buy. Make a guess.
9 Player sitting to the left says "Tomorrow, I'm going to . . ." then writes down when she plans to do. Make a guess
10 Player sitting opposite throws a die. Predict what number.
11 Player sitting to the right throws a die. Predict what number.
12 Player sitting to the right left a die. Predict what number.
13 Player sitting opposite flips a coin. Predict head or tail.
14 Player sitting to the right flips a coin. Predict head or tail.
15 Player sitting to the left flips a coin. Predict head or tail.
16 Write down 1 to 9 on nine small pieces of paper; put them in a hat. Predict what number player sitting opposite will pull out.
17 Write down 1 to 9 on nine small pieces of paper; put them in a hat. Predict what number player sitting to the right will pull out.
18 Write down 1 to 9 on nine small pieces of paper; put them in a hat. Predict what number player sitting to the left will pull out.
19 Blindfold; feel a picture of himself and guess
20 Blindfold; feel a picture of a relative and guess
21 Blindfold; feel a picture of a friend and guess
22 Blindfold; feel and guess a $1 dollar bill; 1 guess only
23 Blindfold; feel and guess a $5 dollar bill; 1 guess only
24 Blindfold; feel and guess a $10 dollar bill; 1 guesses only
25 Blindfold; feel and guess a title of a book; 1 guess TABLE 6-continued

| "SIXTH SENSE" QUESTIONS 10 POINTS EACH | |
|---|---|
| 26 | Blindfold; feel and guess a name of a magazine; 1 guess |
| 27 | Blindfold; feel and guess a title of a book |
| 28 | Player sitting opposite hides a cereal in his left hand. Make a guess |
| 29 | Player sitting to the right hides a coin in his left hand and a folded $1 bill in his right. Make a guess |
| 30 | Player sitting to the left pretends to hide something in both of his hands. Make a guess |
| 31 | Ask to stand up, put a piece of paper with toothpaste on it on her chair. Make a guess before sit down. Don't let her sit down. |
| 32 | Plug ears; blindfold; then cut a small piece off one hair strand. Guess what has happened |
| 33 | Plug ears; blindfold; turn around a few times; another player walks him toward a egg on the floor. Make a guess what is he walking toward before reaching the egg. |
| 34 | Plug ears; blindfold; give him $1 bill (put it in front of him). Guess what good thing has just happened. He'll get to keep the $1 if he guesses right |
| 35 | Plug ears; blindfold; write on a piece of paper to let him have another try. Guess what good thing has just happened. He'll get another try if he guesses correctly |
| 36 | Put a coin on her chair. Sit down and make a guess |
| 37 | Put a driver license on his chair. Sit down & make a guess |
| 38 | Guess whose driver license (from player sitting opposite). |
| 39 | Guess whose credit card (from player sitting te the right) |
| 40 | Guess whose $5 bill (from player sitting to the left) |
| 41 | Guess how much money does player sitting opposite have (within $5) |
| 42 | Guess how much money does player sitting to the right have (within $5) |
| 43 | Guess how much money does player sitting to the left have (within $5) |
| 44 | Blindfolded; plug ears; player sitting opposite leaves the room. Guess who |
| 45 | Blindfolded; plug ears; player sitting to the right leaves the room. Guess who |
| 46 | Blindfolded; plug ears; player sitting to the left leaves the room. Guess who |
| 47 | Player sitting opposite holds one end of a pen; the guessing player holds the other end. Guess who? |
| 48 | Player sitting to the right holds one end of book; the guessing player holds the other end. Guess who? |
| 49 | Player sitting to the right holds one end of a big plate or bowl; the guessing player. holds the other end. Guess who? |
| 50 | Predict what sense the player sitting opposite will get after she spins the needle; just write it down. |

Specific instructions are preferably provided as to how each set of questions 31–36 is to be answered. For example, for taste questions 32, the instructions might provide that the player taking the turn must be blindfolded. For smell questions 34, the instructions might provide that the player must be blindfolded and that he item must be placed 3 to 6 inches from the player's nose. For hearing questions 33, the instructions might provide that the player must be blindfolded, that the object must be placed about 3 to 12 inches from the player's nose, and that absolute silence is required. For touch questions 31, the instructions might provide that the player must be blindfolded, that the player can only touch or rub (not hold) the item with one or two fingers (according to the question), and that the guessing player's hand is to be held and directed by another player. For sight questions 35, the instructions might provide that only 1 guess is allowed, that the card is drawn by an other player; and that the guessing player must be blindfolded during the setting up of the question. For extrasensory perception questions 36, the instructions might provide that absolute silence is required. While various instructions can be used depending on the requirements of a particular sense, or even of a particular question, the object is to provide instructions which make the questions both challenging and fun.

In addition to the established questions, each set of questions can be provided with a number of wild cards. In a preferred embodiment, about one out of every six questions in a set is a wild card. The wild cards within a set can be broken down into different point levels, such as ten wild cards worth 1 point each, seven wild cards worth 3 points each, and three wild cards worth 5 points each. The wild cards for extrasensory perception can all be worth, for example, 10 points. When a wild card question is drawn, the player reading the question is allowed to come up with an original question based on the particular sense from which the wild card was drawn. The wild card question must be fair, reasonable for the number of points provided on the card, and safe. A time limit can be placed on coming up with a wild card question, such as one minute. It is preferable that the time limit be the same as the amount of time allowed for a player to answer a question. If the player reading the question cannot come up with an original wild card question within the time limit, a new card is pulled from the same set of questions, and the game continues.

Spaces can be marked on the game board to indicate where the six decks of cards 31–36 are to be placed. The card deck spaces 31–36 can be positioned approximately equidistant around the periphery of playing area 10, such that the touch cards 31 are positioned adjacent the touch selection area 21, the hearing cards 33 are positioned adjacent the hearing selection area 23, and so forth. The various areas of the board 1 are preferably colored to provide readily apparent contrast between the areas.

In an alternative embodiment, the game can be played with a combination of three or more of the senses. For example, a set of questions corresponding to sight, hearing, and smell can be provided, while sets of questions for the remaining three senses are omitted. The game can also be played without a game board, as will be described further below.

In operation, the game can be played in a number of ways, including by the preferred methods described below. The game is particularly suited to team play. Accordingly, for purposes of this description and the claims herein, "player" shall be understood to mean a single playing unit, such as a single person playing individually, or a team composed of two, three, or more persons.

A preferred method of playing the game using the game board apparatus described above and shown in FIG. 1 will now be described. The object of the game is to collect points in order to become the first player to maneuver his or her icon from the start 2, through the playing area 10, and to the finish 3. Points are collected by correctly answering questions. In the preferred embodiment, the questions are printed on game cards 31–36. The questions are based on the six senses, and answering a question correctly requires either a lucky guess or an accurate use of the sense corresponding to that particular question.

Because the game requires both a question reader and a player, the minimum number of players is two. There is no maximum limit of players. If there is more than one player per team, members of a team can take turns attempting to answer questions or setting up questions for the player taking a turn. Once a player on a team has been designated to answer a question, other team members are not allowed to help answer the question.

Before beginning play, a few preliminaries are taken care of. Each player selects or is assigned an icon to represent that player during the game. The icons are placed in or near the start area 2. A sequence of play is assigned to the players. This can be done in the conventional manner, such as by agreement, or by rolling a die to select the first player, and then proceeding clockwise around the playing table. If using cards, it is recommended that the sets of cards be shuffled before the beginning of each game.

Play then proceeds on a turn-by-turn basis, with the players taking turns in the assigned sequence of play to thereby maneuver each player's assigned icon through the playing area toward the finish. Each turn comprises the following steps. The player taking the turn spins the needle 40 to randomly select one of the senses, i.e. one of the sets of questions 31–36. If the needle 40 lands on the line between two spaces, the player spins again. The player then selects a question from the selected set of questions. This is done by drawing a card from the top of the deck of cards corresponding to the selected set of question. It does not matter whether the card is pulled by the player taking the turn or by another player, as long as the player taking the turn does not read the question on the card After a card has been selected, the question on the card must be set up by the other players before the player taking the turn can attempt an answer. This is accomplished by having other players read the question silently to themselves. The other players then set up the question according to the instructions on the card. For example, if the question reads, "Find two objects that don't belong in a refrigerator (place a coin on top of a milk bottle and a toothpaste cap next to an egg)," one of the other players goes to the refrigerator and places a coin on a milk bottle and a toothpaste cap next to an egg. During the setting up of the question, the player taking the turn may have to be blind folded, have his or her ears plugged, removed to another room, or otherwise prevented from picking up clues as to the subject matter of the question. As mentioned above, instructions can be provided as to how questions for each particular sense are to be answered, in order to make the questions challenging and to prevent the guessing player from picking up clues. If the instructions require a household item that is not available, the question is discarded and a new question is selected from the same set of questions. It is recommended that a systematic order be followed in setting up the questions, so that all players have an equal opportunity to present questions and to come up with wild card questions. For example, on each turn, the player sitting to the right of the player taking the turn can be the designated reader, and is responsible for drawing the card, setting up the question (including thinking up a wild card question if a wild card was drawn), and presenting the question to the player taking the turn.

Once the question has been set up, the player taking the turn attempts to answer the question. In the example above, the player would be led to the refrigerator and another player would say, "Find two objects that don't belong in a refrigerator." A timer can be used to time the turn. The timer can be a watch, a stopwatch, a one minute hourglass, or the like. In the example above, the player would then have, for example, one minute from the opening of the refrigerator to locate and identify the coin and the toothpaste cap.

If the player taking the turn correctly answers the question, the player's icon is moved a sequential number of spaces on the playing area corresponding to the point value of the question. If the icon stops on a space 12 having indicia 13, the player complies with the instructions set forth in the indicia 13. Unless the indicia provides otherwise, the player then repeats the steps of selecting a question and attempting to answer the question. For example, if the instructions say "GO FORWARD THREE," the player's icon is moved forward three more spaces and the player randomly selects a new question. If the instructions say "RELAX. TRY YOUR SIXTH SENSE!," the player selects and attempts to answer a question for extrasensory perception. If the instructions say "LOSE A TURN," the player's turn comes to an end.

If the player taking the turn answers the question incorrectly, the player's turn comes to an end. The next player in the sequence of play then takes a turn. The procedure of taking a turn in the sequence of play is repeated until one of the players wins the game by maneuvering the player's assigned icon to the finish before any other player does so.

The procedure of taking a turn in sequence can be varied such that two players attempt to answer a question simultaneously. The first player to answer the question correctly is awarded the points associated with the question.

As mentioned above, the game can be played with less than all six sets of questions, or without a game board. For example, if the game is played with three sets of cards and without a game board, the three sets of cards can be shuffled together. The players then take turns by selecting a card from the top of the combined deck and attempting to answer the question. The game can be played by tallying points for each player according to which questions the player answers correctly. Alternatively, the game can be played by collecting correctly answered cards, with the object being to collect a certain number of cards (e.g. fifteen cards), or a certain number of cards from each of the sets (e.g. 3 cards for touch, 2 cards for taste, 2 cards for hearing, 2 cards for smell, 1 card for sight, and 1 card for extrasensory perception). The step of taking a turn is repeated until a winner of the game is determined.

Although the present invention has been described in terms of specific embodiment, it is anticipated that alterations and modifications thereof will no doubt become apparent to those skilled in the art. It is therefore intended that the following claims be interpreted as covering all such alterations and modifications that fall within the true spirit and scope of the invention.

I claim:

1. An apparatus for a game utilizing the senses, said apparatus comprising:

a means for testing acuity of the senses including a set of questions corresponding to each of three or more selected senses, said selected senses selected from the group consisting of sight, hearing, taste, smell, touch, and extrasensory perception, each of said questions in each of said sets designed to test a player's sensory acuity for that particular sense, and a means for randomly selecting one of said questions on a turn-by-turn basis to thereby utilize said questions to play said game.

2. The apparatus of claim 1, wherein each of said questions has a point value corresponding to the level of difficulty of said question.

3. The apparatus of claim 2, further comprising a game board, said game board having a start area, a finish area, and a playing area positioned between said start and said finish, said playing area divided into a plurality of sequential spaces, and two or more icons, said icons sized to fit in said spaces.

4. The apparatus of claim 3, further comprising indicia on some of said spaces, said indicia providing instructions relating to selection of questions and movement of said icons through said playing area.

5. The apparatus of claim 1, wherein said means for randomly selecting a question is weighted such that of said three or more selected senses, said means is most likely to select a question for touch, less likely to select a question for sight than for taste, hearing, or smell, and least likely to select a question for extrasensory perception.

6. An apparatus for a game utilizing the senses, said apparatus comprising:

a game board, said game board having a start area, a finish area, and a playing area positioned between said start and said finish, said playing area divided into a plurality of sequential spaces;

two or more icons, said icons sized to fit substantially in said spaces;

a set of questions testing a player's sense of sight, a set of questions testing a player's sense of hearing, a set of questions testing a player's sense of taste, a set of questions testing a player's sense of smell, a set of questions testing a player's sense of touch, each of said questions having a point value corresponding to the level of difficulty of said question, and a means for randomly selecting one of said questions on a turn-by-turn basis to thereby utilize said questions to play said game by maneuvering said icons through said playing area in accordance with said point values.

7. The apparatus of claim 6, wherein said means for random selection is weighted such that said means is most likely to select a question for touch and less likely to select a question for sight than for taste, hearing, or smell.

8. The apparatus of claim 7, further comprising a set of questions testing a player's sense of extrasensory perception.

9. The apparatus of claim 8, wherein said means for random selection is weighted such that said means is most likely to select a question for touch and less likely to select a question for sight than for taste, hearing, or smell, and least likely to select a question for extrasensory perception.

10. The apparatus of claim 8, further comprising indicia on some of said spaces, said indicia providing instructions relating to selection of questions and for maneuvering said icons through said playing area.

11. The apparatus of claim 6, further comprising indicia on some of said spaces, said indicia providing instructions relating to selection of questions and for maneuvering said icons through said playing area.

12. A method of playing a game using the senses, said method comprising the steps of:

(a) providing a means for testing acuity of the senses including a set of questions corresponding to each of three or more selected senses, said selected senses selected from the group consisting of sight, hearing, taste, smell, touch, and extrasensory perception, each of said questions within each of said sets designed to test a player's sensory acuity for that particular sense;

(b) taking a turn, wherein said step of taking a turn comprises randomly selecting one of said questions and having a player attempt to answer said selected question; and (c) repeating said step of taking a turn until a winner of said game is determined.

13. The method of claim 12, wherein each of said questions has a point value corresponding to the level of difficulty of said question.

14. The method of claim 13, further comprising the step of tallying points for each player for each of said questions correctly answered by that player, said points being accumulated in accordance with said point values.

15. The method of claim 13, further comprising providing a game board, said game board having a start area, a finish area, and a playing area positioned between said start and said finish, said playing area divided into a plurality of sequential spaces, providing two or more icons, said icons sized to fit in said spaces, and said step of taking a turn further comprising, upon a player correctly answering one of said questions, moving said player's icon a sequential number of spaces on said playing area corresponding to the point value of said correctly answered question.

16. The method of claim 15, further comprising providing indicia on some of said spaces, said indicia providing instructions relating to selection of questions and for movement of said icons through said playing area, and said step of taking a turn further comprising the step of, upon moving said icon to a new space, complying with said instructions on said indicia, if any, in said new space prior to repeating said step of taking a turn.

17. A method of playing a game using the senses, to be played by two or more players, comprising the steps of:

(a) providing a game board, said game board having a start area, a finish area, and a playing area positioned between said start and said finish, said playing area divided into a sequence of spaces;

(b) providing two or more icons, said icons sized to fit in said spaces;

(c) providing a set of questions testing a player's sense of sight, each of said questions having a point value corresponding to the level of difficulty of said question, (d) providing a set of questions testing a player's sense of hearing, each of said questions having a point value corresponding to the level of difficulty of said question, (e) providing a set of questions testing a player's sense of taste, each of said questions having a point value corresponding to the level of difficulty of said question, (f) providing a set of questions testing a player's sense of smell, each of said questions having a point value corresponding to the level of difficulty of said question, (g) providing a set of questions testing a player's sense of touch, each of said questions having a point value corresponding to the level of difficulty of said question, (h) providing a means for randomly selecting one of said sets of questions, (i) assigning one of said icons to each of said players, (j) placing said assigned icons in said start area, (k) assigning a sequence of play to said players, (l) having said players take turns in said assigned sequence of play to thereby maneuver each player's assigned icon through said playing area, each of said turns comprising, (i) operating said means to thereby randomly select one of said sets of questions;

(ii) selecting a question from said selected set of questions;

(iii) attempting to answer said selected question; and (iv) if said question was answered correctly, moving said player's icon a sequential number of spaces on said playing area corresponding to said point value of said question, and then repeating said step of taking a turn, or (v) if said question was answered incorrectly, ending that player's turn, whereupon the next player in said sequence of play takes one of said turns; and (m) repeating said sequence of taking a turn until one of the players wins said game by maneuvering said winning player's assigned icon to said finish before any other player.

18. The method of claim 17, wherein said means for random selection is weighted such that said means is most likely to select touch and less likely to select sight than taste, hearing, or smell.

19. The method of claim 17, further comprising providing indicia on some of said spaces, said indicia providing instructions relating to selection of questions and for movement of said icons through said playing area, and said step of taking a turn further comprising the step of, upon moving said icon to a new space, complying with said instructions on said indicia, if any, in said new space prior to repeating said step of taking a turn.

20. The method of claim 17, further comprising the steps of providing a means for timing a turn, and timing each of said turns.

21. The method of claim 17, further comprising providing a set of questions testing a player's sense of extrasensory perception, each of said questions having a point value corresponding to the level of difficulty of said question.

22. The method of claim 21, wherein said means for random selection is weighted such that said means is most likely to select touch, less likely to select sight than taste, hearing, or smell, and least likely to select extrasensory perception.

23. The method of claim 21, further comprising providing indicia on some of said spaces, said indicia providing instructions relating to selection of questions and for movement of said icons through said playing area, and said step of taking a turn further comprising the step of, upon moving said icon to a new space, complying with said instructions on said indicia, if any, in said new space prior to repeating said step of taking a turn.

24. The method of claim 21, further comprising the steps of providing a means for timing a turn, and timing each of said turns.

* * * * *